US006980088B2

(12) United States Patent
Stambaugh

(10) Patent No.: US 6,980,088 B2
(45) Date of Patent: Dec. 27, 2005

(54) RESTAURANT TABLE TURN SYSTEM NETWORK

(75) Inventor: Robert W. Stambaugh, St. Pete Beach, FL (US)

(73) Assignee: RSDS Holdings, LLC, St. Petersburg Beach, FL (US)

( * ) Notice: Subject to any disclaimer, the term of this patent is extended or adjusted under 35 U.S.C. 154(b) by 110 days.

(21) Appl. No.: 10/634,683

(22) Filed: Aug. 5, 2003

(65) Prior Publication Data

US 2005/0030162 A1 Feb. 10, 2005

(51) Int. Cl.[7] ..... G08B 1/00
(52) U.S. Cl. ..... 340/286.09; 705/15
(58) Field of Search ..... 340/286.09, 825.29; 705/15, 5

(56) References Cited

U.S. PATENT DOCUMENTS

| | | | | |
|---|---|---|---|---|
| 3,241,117 A | | 3/1966 | Schottle et al. | |
| 3,310,797 A | | 3/1967 | Auger | |
| 3,742,141 A | | 6/1973 | Duncan et al. | |
| 3,797,009 A | | 3/1974 | Crudgington | |
| 4,194,181 A | | 3/1980 | Brundage | |
| 4,222,111 A | | 9/1980 | Sloan et al. | |
| 4,449,186 A | | 5/1984 | Kelly et al. | |
| 4,530,067 A | | 7/1985 | Dorr | |
| 5,032,834 A | | 7/1991 | Kane et al. | |
| 5,151,692 A | | 9/1992 | Hirahara | |
| 5,272,474 A | | 12/1993 | Hilliard | |
| 5,839,115 A | * | 11/1998 | Coleman | 705/15 |
| 6,088,681 A | * | 7/2000 | Coleman et al. | 705/15 |
| 6,580,360 B1 | * | 6/2003 | McKee et al. | 340/286.09 |
| 2002/0082879 A1 | | 6/2002 | Miller | |
| 2003/0040943 A1 | | 2/2003 | Bates et al. | |

* cited by examiner

*Primary Examiner*—John Tweel, Jr.
(74) *Attorney, Agent, or Firm*—Dennis G. LaPointe

(57) ABSTRACT

A restaurant table turn control and display system for providing real-time communication to staff personnel throughout key areas of a restaurant, comprising two or more monitoring consoles, each having a restaurant layout display having indicia representative of tables available for seating in the restaurant and for communicating to the staff other requirements or needs; a touch screen for activating desired status changes on the system; LED bulbs arranged in an underlying relationship to the indicia on the restaurant layout or software driven images depicted on the display screen, which can be a combination monitor and touch screen; and a controller circuit with programmable circuitry for operating and controlling the system, including providing status changes and communicating such status changes simultaneously to other monitoring consoles electrically operatively connected to said monitoring console.

24 Claims, 10 Drawing Sheets

RESTAURANT TABLE TURN SYSTEM NETWORK

The invention relates to a networked system for real time monitoring and controlling restaurant table usage and availability and communicating table status to and between key stations and staffers simultaneously.

BACKGROUND OF THE INVENTION

Table monitoring systems are known in the art, but most require various staffers, and especially the host or Maitre-D, to either travel partially through the dining room to personally observe the status of the table. (Throughout this disclosure, "host" will be used generically to represent a "host," "hostess" or __ "Maitre-D.") In other cases, the host must communicate through head phones or a radio device with the floor staffers to verbally obtain information. This can be disruptive. A host is generally very busy trying to keep track of incoming clients, numbers within the party, which server got the last table and who is next to fairly distribute clients to servers, etc. Having to stop and try to talk to staffers can disrupt a chain of thought. However, a monitoring board or screen where real time status can be observed at a glance will allow a host to more efficiently seat clients. Table turn-over is increased and servers get to serve more clients over a shorter period. Additionally, it assists the bussing staff in their ability to easily identify tables needed to be cleaned and reset. Clients are impressed with the efficiency of the restaurant and return more frequently. So everybody does well, including the restaurant owners from the greater efficiency obtained with a real-time monitoring and control system.

As mentioned above, some monitoring and control systems known in the art are in a master and slave configuration. The main control functions are at the master station. Others require additional implements such as a magnetic wand to activate the magnetic switches in the circuit boards like that disclosed in U.S. Pat. No. 5,032,834. If the magnetic wand is misplaced or lost, the host can not operate the board and disruption in the seating of clients may occur from the delay in trying to locate the wand. Further, if the wand is left on the board for a short time period, it can inadvertently make changes to the status of tables, including a portion of the board's tables or all the tables on the board. Further, the wand is difficult for service staff and bussers to handle because it usually is attached to a string and hangs down the side of the surface supporting the board. Otherwise, the host needs to personally verify status changes of tables. Generally, when LEDs are used in conjunction with magnetic features, the LED lighting is typically low density, as is the case in the system commercialized and represented by the U.S. Pat. No. 5,032,834. In addition, a key-pad is needed in order to enter status information, words are used to show status, there is no active legend to reinforce or train personnel and the device requires a multi-step process, not required by the present invention.

SUMMARY OF THE INVENTION

The present invention is a cooperative, simplistic and dedicated networked system of restaurant floor plan monitors. Monitors provide status about all of the dining tables and available seating as well as other status such as parties waiting, manager required at the front desk, or other custom indicators that may be required.

The system is cooperative in that it requires input by all personnel who work in or support the restaurant dining areas and, likewise, displays all resulting inputs on all monitors on the network. While it may be conducive to have job-specific personnel enter the table status as it relates to their work, the system can be operated easily and intuitively by anyone who wants to update the table status.

The present invention is a dedicated system in that its application is specific only to the task of providing status of tables (wherever referred to hereinafter, "tables" implicitly includes available restaurant seating anywhere in the restaurant) and communicating various status between personnel. No cross-functionality of any kind is supported or encouraged, which keeps its usage uncomplicated.

This inventive dedicated system is, consequently, a simplistic apparatus making it extremely user friendly. Each monitor in the system incorporates a visual display representative of the restaurant floor plan on an easily visible area, for example, about 18 inches diagonally measured. The entire floor plan area covers a pressure-sensitive touch screen panel. A single touch, at any time, on any depicted table will cause an LED (or highlighted illumination) under that table to change state. Usage is further simplified to a single touch by choosing a logical sequence by which to cycle the table states, that is, if a table is "Vacant," the next logical state to cycle to after a touch update is "Occupied". When the state is "Occupied," the next state to cycle after a touch update would be "Bus Table." When the state is "Bus Table," the next state to cycle to after a touch update would be "Vacant." In addition, if a "Bus Table" state is not cleared in a pre-settable time increment, then some other means of status change can be observed. For example, if the "Bus Table" indicator is a blinking light, then after the time increment passes, if the table status has not been manually changed by the bus boy, then the "Bus Table" indicator might change to a rapid blinking or flashing of the light thereby advising the host that the table still is not ready and if necessary, the Manager on Duty can also immediately assess the need to provide necessary support to the bus station crew to clear the tables more efficiently.

After changes are made to a local monitor, the status change is automatically communicated to each station monitor in the network so that all networked monitors reflect the exact same status. This functionality therefore provides an efficient means of real-time monitoring of table status in a restaurant that is simple and intuitive. Further, to prevent the inadvertent entry of a table status by someone brushing by or inadvertently touching the screen, it is preferable that the circuitry be designed and pre-programmed to provide a sound indicator such as an audible beep when the board is touched to activate a table status change.

Another more specific example may be as follows:

After a party is seated, the host merely touches the corresponding table on the screen, turning an indicator light (LED) "ON" or highlighting (software driven illumination) the table if an LCD type touch screen is used, simultaneously illuminating the same table on all of the boards or screens located in the service areas. These lighted indicia may be "red" in color. This now informs all service personnel that the table has been seated. Once the party has left the table, the server touches the corresponding table on any of the service area boards/screens, changing it to a blinking indicator light, simultaneously illuminating the same table on all the service boards/screens as well as the host's board/screen, which informs the bus staff that a table needs to be serviced (cleared, cleaned and prepared for the next seating). This allows the host to be pro-active by paging the next party waiting to be seated. If the table to be cleaned is not bussed within a prescribed time (for example, six or eight minutes), the blinking light status will change to a more rapid blinking or flashing of the light or illuminated display. This informs the manager and the staff that the table has not been bussed in a timely manner. Once the busser has cleaned the table, the busser touches the corresponding table on any one of the nearby service screen boards and turns the indicator light out or "OFF," simultaneously shutting off all of the corresponding blinking lights on the service board screens in the network, thereby letting the host, manager and staff know that the table is ready for seating.

An additional embodiment in the functionality of the present invention is the incorporation in the touch screen system of a "Reserve/Hold" program. This program allows the seating host to mark tables to be held for guests to be seated at a later time or allows a manager to close down one or more tables, for which, seating is not desired. There may be a group wanting a reserved section of the restaurant for a meeting or special event and the area needs to be closed-off for the meeting or event.

One example of operating or performing this "Reserve/Hold" function is by touching the table(s) to be held or reserved and holding the touch for a specific pre-determined and pre-programmed time frame, such as 3–5 seconds. While an initial touch of the screen may change the table to be lighted in one color such as green, holding the touch screen down for the short time period such as 3, 4, or 5 seconds, will change the lighted table to a second color such as red. Further, it is preferable that this functionality be done only at the host station console, but certainly the circuitry can be designed to allow other stations to perform the same function.

Another additional embodiment, alluded to above, is the incorporation of a "Call for Manager" feature. This allows the host at the front desk to touch (press) the indicia labeled "MOD to the Front Desk" thereby activating the indicator light under the indicia, and in turn illuminating all the boards/screens located in the service areas. In this way, no matter where the manager on duty is, when the manager is near one of the monitoring stations, the need for his services at the front desk can be immediately observed. It is preferable that, to ensure that the MOD notices his or her call to the front desk, that the lighted feature be designed to provide for a flashing mode. This is very helpful when a client at the front desk or host area has special needs or when dealing with personnel needs. In these cases, the host may not want to leave the area if the patron is disruptive and control of the situation must be maintained. The system serves to call the manager on duty to the area without notice to patrons at the front desk. If the manager on duty is not in his or her office, he or she can observe the need for his or her presence at the front desk from any other monitor station in the restaurant. For example, if the manager on duty has entered the kitchen and assuming the restaurant has installed a monitor in the kitchen, then the manager on duty is informed by the lighted indicator light or highlighted indicia and he or she is being requested to immediately respond to the front desk to assist the host.

An additional embodiment incorporated into the invention allows the staff to be informed when a dinner wait has begun. This gives the staff advance notice that patrons are waiting to be seated. The hostess typically touches the touch screen where indicia such as "One To Five Parties On A Wait" or "Six Or More Parties On A Wait." The actual number on the indicia is typically customized based on the size of the restaurant and its anticipated turn over rate. Therefore, the example given is for discussion purposes only. The message is simultaneously illuminated on all the boards in the restaurant. In this way, the wait staff, the kitchen staff, the bus station staff and the manager on duty can get an idea of the level of activity in the dining room, that is, if the flow or turn over is progressing at an acceptable rate or if a more concentrated effort needs to be made to clear tables or get the food out of the kitchen, if the kitchen is causing the back-up of patrons waiting to be seated.

Although "red" and "green" colored bulbs or highlighted illuminations on the touch screens are mentioned in the above examples, other colors may typically be used. In fact, blue lights are also popular to use in such lighting arrays so one anticipated popular combination may be red and green, red and blue, or blue and green lights/illuminations. In addition, other verbiage can be used to reflect the dinner wait language, the MOD to front desk language, etc. Certain code numbers can be used instead such as "Code III" as shown for the bussing related legend discussed below.

The present invention also preferably includes a dedicated portion of each board/screen that includes a legend indicating the light status for various conditions. For example, if the table were vacant and ready for seating, then the indicator light under the table indicia would be "off." Following the above examples, the legend would indicate that a table to be bussed has a "blinking" light under the table indicia. A table not bussed in a timely manner would have a rapidly blinking or "flashing" light under the table indicia. An occupied table would have a light "on" under the table indicia. This legend portion of each board is very useful for training new staff members and as a refresher guide for the staff to quickly recognize the symbolism of the light status for each table. That is, the legend reinforces the functions that each of the service staff person is performing, thereby also serving as a training tool for new staff personnel.

When LED bulbs are used, the LED bulb array may be arranged on a circuit board separate from the board having the programmable circuitry. This will allow more flexibility and cost savings when manufacturing standard boards, for a variety of restaurant layouts and merely customizing the board holding the LED bulbs for specific restaurants ordering the system. For larger restaurant chains, where the layout is the same for all its restaurants, then the programmable circuitry and LED bulbs may be integrated on one circuit board.

Of course, when touch screens and display monitors are integrated, the software that depicts the images of the tables, etc., present multiple advantages in that the software can be limited to operating the touch screen itself which is in an overlying relationship to a restaurant overlay depicting the tables, etc., or the layout of the restaurant with its table arrangement can be pre-programmed in the programmable processor circuitry to save and pull up on the display screen one or more alternative table arrangements for the specific restaurant.

In another embodiment where the integrated display monitor and touch screen is not used, the present invention may optionally include a second restaurant overlay, which has indicia typical of selectively grouped tables designated for multiple patrons requiring the combining of tables to seat said multiple patrons together. This second restaurant overlay is generally configured to be in an overlying face-to-face relationship with the restaurant overlay originally provided with the monitoring station. Touching the touch screen over one of the core tables within the group will provide the specific status condition for the grouped tables.

Some of the key points, but not limited to, associated with the present invention are the following:

a. The present invention utilizes sophisticated "TOUCH SCREEN" technology;

b. Computer chip programming is incorporated in the present invention;

c. Real-time table status reports are readily observable at any station;

d. Modules or monitors at key stations throughout the restaurant allows the system's utilization by the entire restaurant staff, which maximizes real-time information to be disseminated to the staff;

e. The present invention is a single touch system;

f. No stylist is required for activating various functions of the system;

g. There is an active legend system for training and reinforcing the functionality of the touch screen system;

h. Grouping table capacity with overlay, that is, an overlay touch screen with typically grouped tables for larger groups of patrons can be placed on the monitors so that when touched, a status of the occupancy of the table grouping can be represented in real-time to all staff members (this can also be done using alternative layouts generated with software), i. Higher intensity LED lighting or illuminated highlights obtained with touch screens;

j. Expanded touch area for speed and accuracy;

k. All monitors or modules are effectively masters, no slaves are utilized; and l. No separate push button keypad to input information about the status of a table.

DETAILED DESCRIPTION OF THE INVENTION

Figure 1:
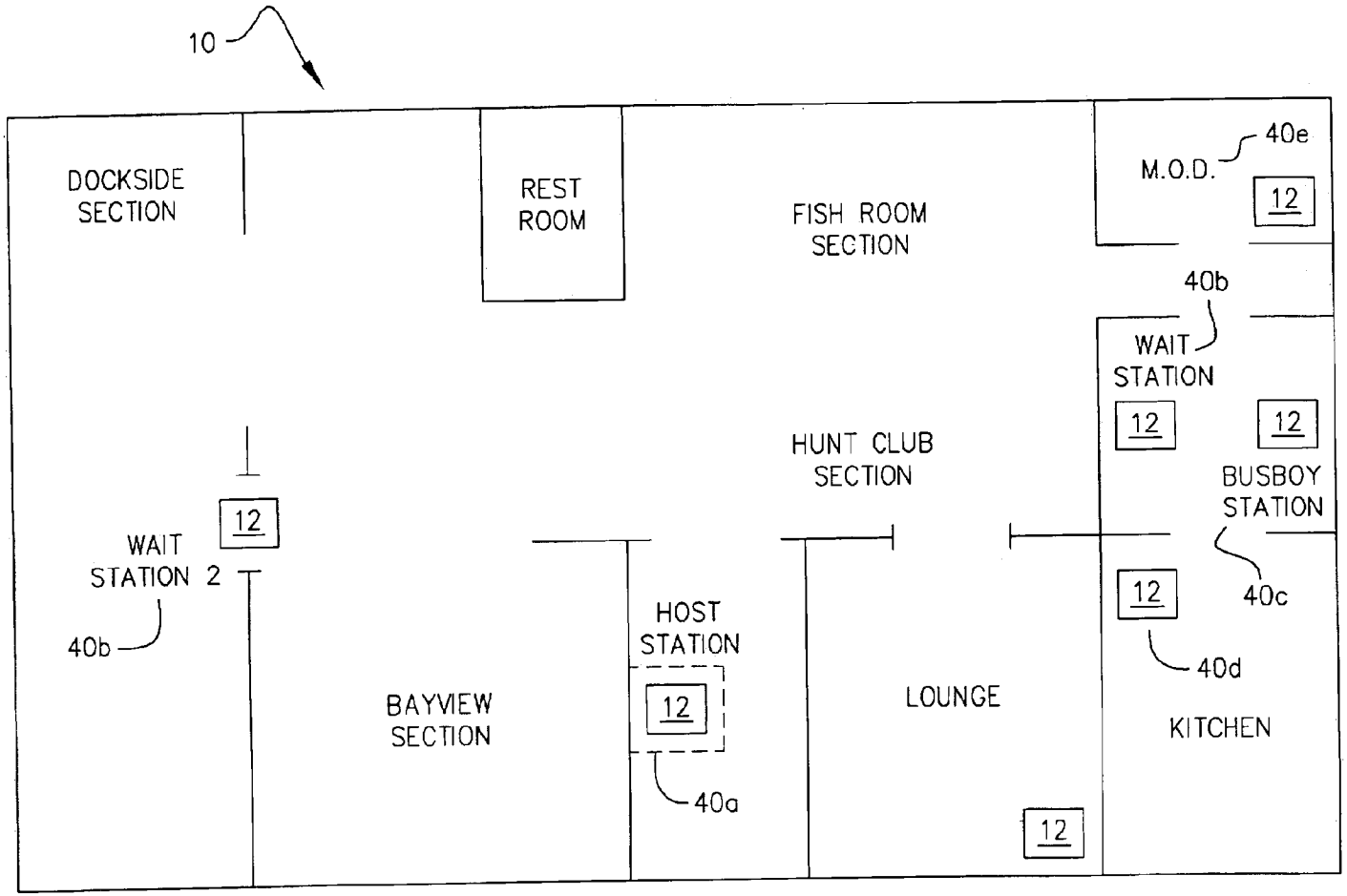
FIG. 1 is a conceptual depiction of a restaurant floor plan with monitoring consoles according to the present invention located in examples of key stations within the restaurant.

Referring now to the drawings, FIGS. 1–4 generally depict the overall concept of the usefulness of the invention where FIG. 1 is a conceptual depiction of a restaurant floor plan with monitoring consoles according to the present invention located in examples of key stations within the restaurant.

Figure 2:
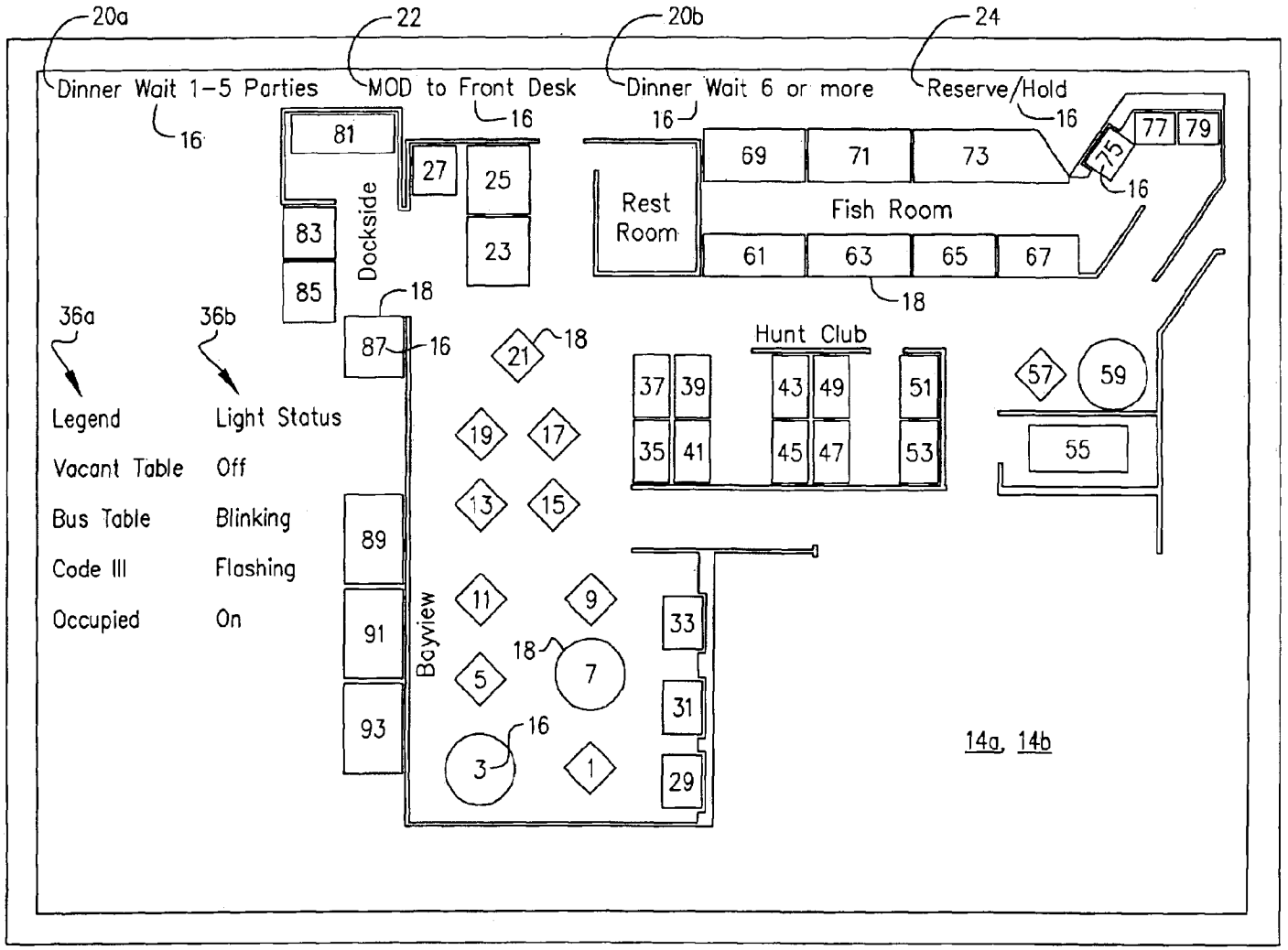
FIG. 2 is a representative restaurant layout of tables in various sections of a typical restaurant with numerical indicia (odd numbers only so not to be confused with the even number system used to number the features of the invention) indicating hypothetical table numbers.
Figure 2A:
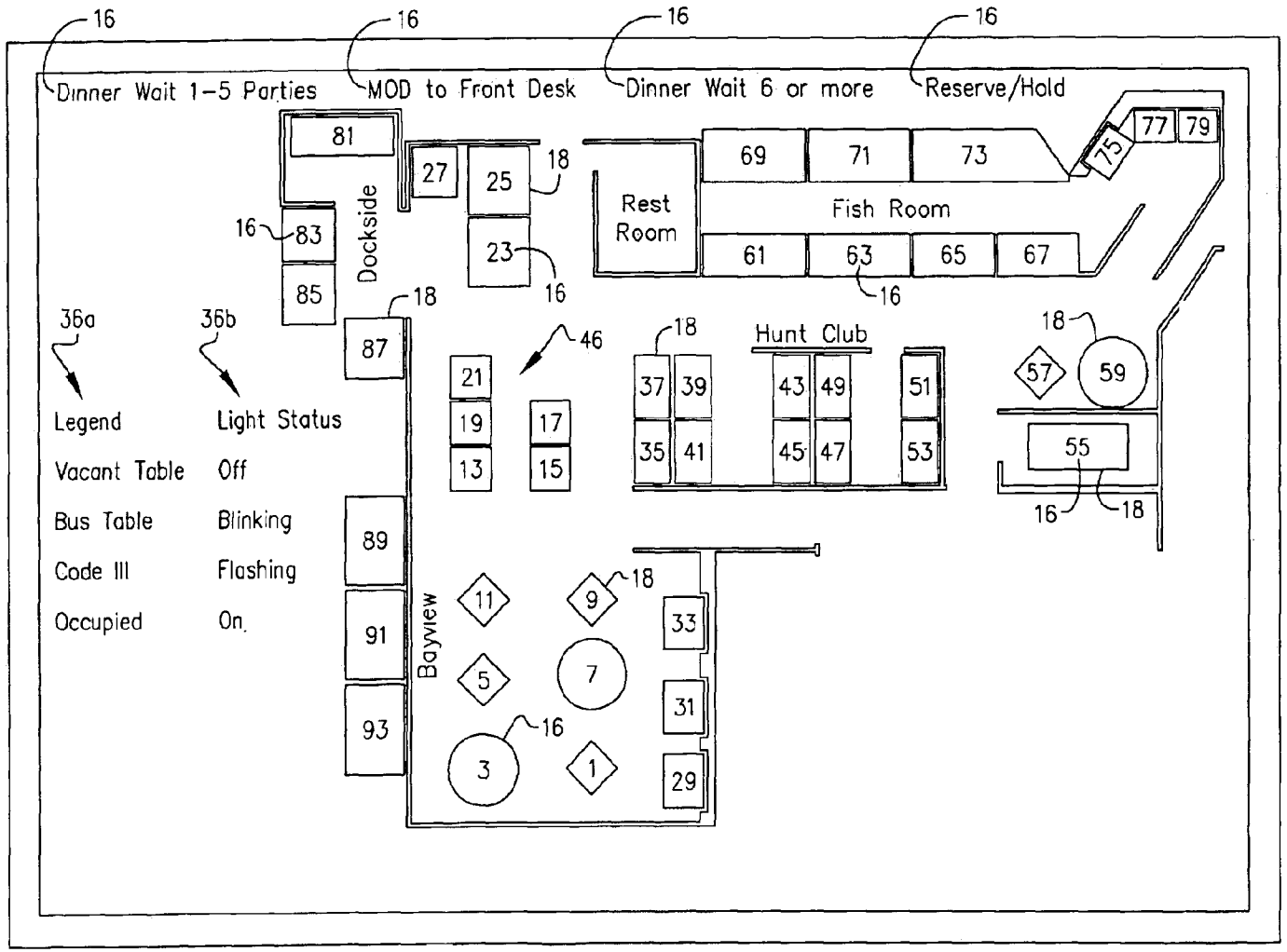
FIG. 2*a* is an example of the use of an alternative overlay for grouping of tables or an image change showing an alternative arrangement of tables, from that depicted in FIG. 2.

FIG. 2 is a representative restaurant layout of tables 18 in various sections of a typical restaurant with numerical indicia 16 (odd numbers for table designation are used only so not to be confused with the even number system used to number the features of the invention) indicating hypothetical table numbers 18.

Figure 3:
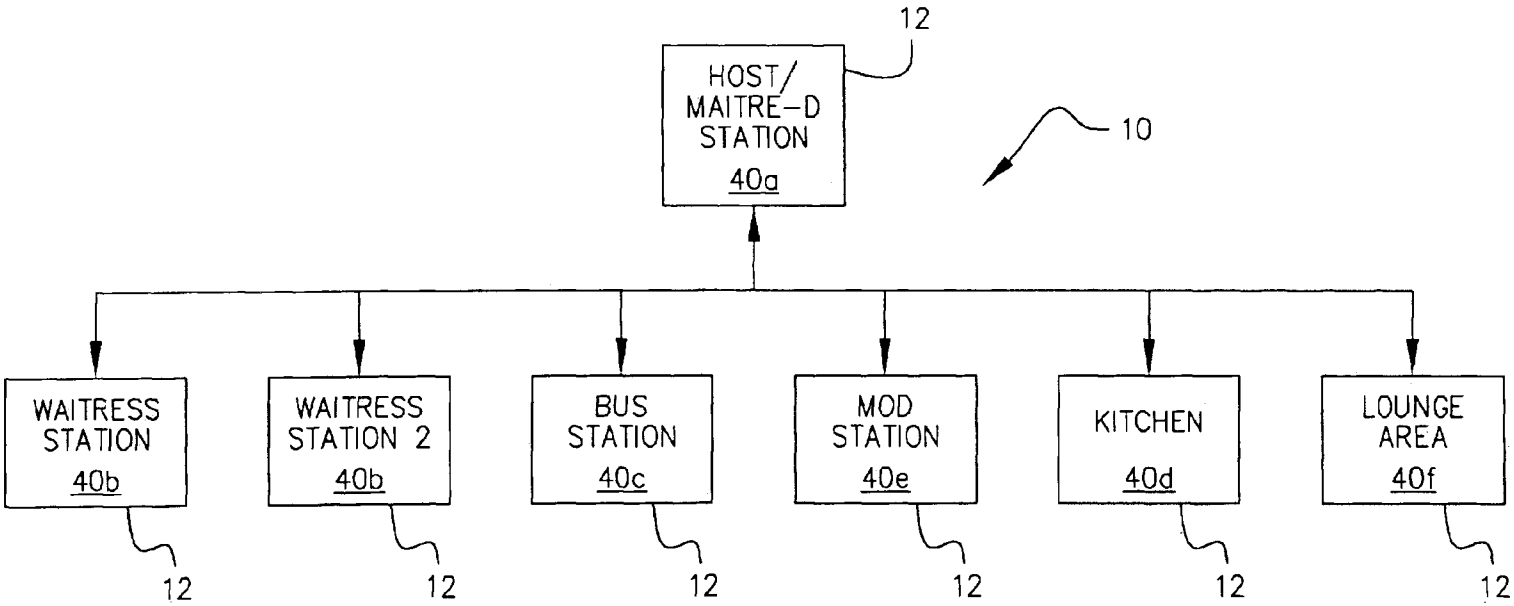
FIG. 3 is a schematic flow chart representative of the data flow between all stations.

FIG. 3 is a schematic flow chart representative of the data flow between all stations. No matter where the console is activated, real-time transfer of the same information (lights/indicia illuminated) is readily observable at all the stations in the network. That is, status change is observed at all the stations simultaneously.

Figure 4:
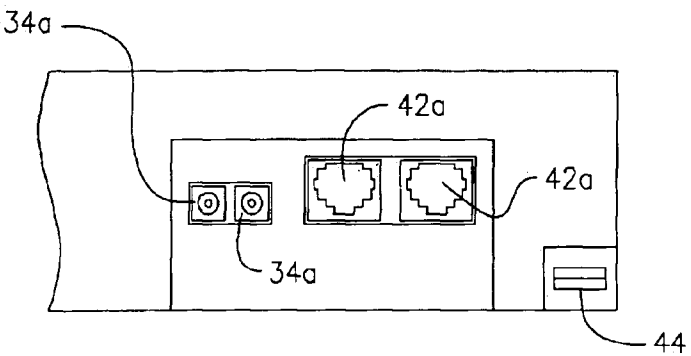
FIG. 4 is an example of a terminal connection area showing power ports and cabling ports to interconnect the individual consoles.

FIG. 4 is an example of a terminal connection area showing power ports 34*a* and cabling ports 42*a* to interconnect the individual consoles.

FIGS. 1, 2, 2*a*, 3–5, 6*a*, 6*b*, 7, 8 and 9A–9B disclose one or more embodiments of the present invention, which is a networked restaurant table turn control and display system, which is depicted generally as 10.

The system 10 includes two or more monitoring consoles, where each monitoring console 12 includes means 14 for displaying a restaurant layout having indicia 16. The indicia 16 is typically representative of tables 18 available for seating in the restaurant and being for communicating to the staff working in the restaurant, one of a dinner wait of a pre-set number of patrons or less 20*a* (for example, 5 or less as shown in the drawings), a dinner wait of a pre-set number of patrons or more 20*b* (for example, 6 or more as shown in the drawings), a need to call the manager on duty to the front desk 22, a table reservation and hold mode 24 and combinations thereof. Certainly, the indicia 16 can be customized for the needs of the specific restaurant. But having the indicia 16 related to calling the manager on duty to the front desk 22 and the reservation/hold 24 indicia is anticipated to be valuable indicia used by the restaurant. The patron wait related indicia may also be popular as these give the manager on duty and the kitchen staff real time communications as to whether or not food is coming out fast enough to support timely turn-over of the tables or if the tables need to be cleared even faster to catch up with the wait.

The invention further includes a housing comprising each console 12 with a front monitor-like front face. The front face would display the layout of the restaurant by the use of an overlay 14*a* in an overlying relationship with a touch screen 26, or by the use of an image 14*b* depicted on a touch screen monitor 26. The touch screen 26 serves as means for activating desired status changes on the system 10 such that when the restaurant layout is touched on a selected indicia 16 on the overlay 14*a* or on the image 14*b* displayed on the screen 26, the desired status change on the networked system 10 for the selected indicia 16 is activated. The touch screen 26 is typical of touch screen technology known in the art with sensors to activate the electronic system, such as those used on touch screen cash registers in restaurants.

The console 12 includes means 28 for illuminating the selected indicia 16. This can be accomplished by having a plurality of spaced-apart light emitting diode (LED) bulbs 28*a* arranged in an underlying relationship to the touch screen 26, so that when the selected indicia 16 is illuminated, it is readily observable by an observer looking at the console's screen 26 or overlay 14*a*. A circuit board having various arrays of LED bulbs 28*a* may be such that the bulbs are essentially uniformly arranged on the board or at least predominantly located on the board to ensure the appropriate scheme of lighting options are available under the indicia 16 laid out on the display 14, whether that be an overlay 14*a* or an image 14*b* on a screen 26. As mentioned above, the LED bulb array may be arranged on a circuit board separate from the board having the programmable circuitry described below. This will allow more flexibility and cost savings when manufacturing standard boards for a variety of restaurant layouts and merely customizing the board holding the LED bulbs 28*a* for specific restaurants ordering the system. For larger restaurant chains, where the layout is the same for all its restaurants, then the programmable circuitry and LED bulbs 28*a* may be integrated on one circuit board.

When the means 14 for displaying the restaurant layout having indicia 16 is a display screen 14, on which an image 14*b* of the desired restaurant layout is depicted, the software to generate the image 14*b* is pre-programmed in the programmable circuitry means 32.

Another method of providing means 28 for illuminating the selected indicia 16 is the inclusion of highlighting means 28*b* for illuminating selected indicia 16. The highlighting means 28*b* is also typically generated or enabled using software pre-programmed in the programmable circuitry means 32.

As mentioned above, the means 28 for illuminating the selected indicia 16 can include a plurality of spaced-apart light emitting diode (LED) bulbs 28*a* arranged in an underlying relationship to the touch screen means 26, such that when one of the plurality of LED bulbs 28*a* is lighted under the selected indicia 16, the selected indicia 16 is visibly illuminated and readily observable on the display screen 14*b*.

One skilled in the art in computer software writing, given the operational features of the circuitry and the functional input and output parameters required in the present invention, including the need to communicate between consoles on a real-time basis, can author the software that enables the system for operatively lighting the touched indicia 16, whether the display means 14 is an overlay 14*a* with underlying touch screen 26 and LED bulbs 28*a* underlying the touch screen 26, or whether the display means 14 is a combined LCD type of screen like a touch screen computer monitor where the images 14*b* of the restaurant layout can be imaged directly on the screen 26. The highlighting or illuminating of the indicia 16 on the screen image 14*b* can also be programmed in the software to indicate one color for occupied status, another color for hold status, blinking color for need to be bussed status and flashing color for need to be urgently bussed status (or has not been bussed with prescribed time limit pre-programmed in the system).

A controller circuit 30 is in electronic operative communication with the touch screen 26 and, when incorporated in the system, the plurality of LED bulbs 28*a*. The controller circuit 30 includes programmable circuitry 32 as means for operating and controlling the system 10, including providing status changes and communicating such status changes simultaneously to other monitoring consoles 12 electrically and operatively connected to the monitoring console 12 in which input is provided.

Typical status changes including table status changes and communications to the staff working in the restaurant of one of either the dinner wait of the pre-set number of patrons or less 20*a*, the dinner wait of the pre-set number of patrons or more 20*b*, the need to call the manager on duty to the front desk 22, the table reservation and hold mode 24, or the combination of any of these options.

Electrical power in the form of DC power (DC transformer adapter line connected to an AC source of power) should be sufficient to operate the system. Power may be supplied through one console 12 and the remaining consoles 12 could then be powered from this single source with the necessary cabling between each console. Alternatively, each unit may be powered separately. As further described below, it is more efficient to have a single power source to provide the flexibility to connect one of the consoles to the nearest AC outlet. A 12 VDC power supply rated at 2 amps DC and 0.5 amps for each monitor on the network over three monitors is sufficient to power the invention 10.

The portion of the indicia 16 representative of tables 18 available for seating in the restaurant is preferably arranged in an array representative of the actual table layout for the restaurant in which the system is intended to be used, as shown in FIG. 2.

The restaurant layout overlay 14 or the image 14*b* displayed on the touch screen 26, may also include a designated legend and light status indicia portion (36*a*,36*b* respectively) indicative of the meaning of the light status observed under each of the indicia 16 representative of tables 18 available for seating in the restaurant. The designated legend indicia portion 36*a* may include selected indicia for vacant table, table ready for bussing, table not bussed within desired time period, and table occupied, as shown in the figures. The actual wording is not important and the actual placement on a console 12 overlay 14*a* or image 14*b* is done to suit the needs of the restaurant and its floor plan as depicted on the overlay 14*a* or image 14*b*, so that all staff personnel understand what is being communicated.

On the other hand, the light status indicia portion 36*b* may include "OFF" for each vacant table, "blinking" for each table ready for bussing, "flashing" for each table not bussed within a desired time period and "ON" for each table occupied. "Flashing" as defined herein is merely a change in the rate of off and on (blinking) such that it is increased at a rate that one may consider the light to be "flashing." In other words, for exaggerated purposes only to show an example, a light that goes from "ON" to "OFF" and back to "ON" in 2 second increments may be considered "blinking" but if the rate changes to a full cycle "ON" to "OFF" to "ON" in less than a ½ of a second, then this may be considered "flashing." Of course, other equivalent status indicators are contemplated by the invention in terms of how the LED bulbs 28*a* operate or how the highlighting feature of the integrated touch screen/image display is programmed. For example, instead of blinking lights, other additional colored lights or illuminated highlights may be used. The specific examples of how one communicates status in terms of the lighting is therefore not limited herein to no light, illuminated light, blinking light, flashing light, or even two colors for the lighting or illumination feature. A third color may instead be used for the bussing needs or a fourth light or illuminated highlighted color may be used for the need to urgently bus a table. What is important is the attaining of a readily observable real time communication between the staff.

When incorporated into the embodiment using LED bulb technology, the spaced-apart LED bulbs 28*a*, which are aligned beneath the indicia 16 representative of each table 18 are preferably grouped in combinations of a first color LED bulb 28*a* and a second color LED bulb 28*a*. The first color LED bulbs 28*a* and the second color LED bulbs 28*a* may be selected from two of the group consisting of green, red and blue LED bulbs 28*a*, where the first color LED bulbs 28 are uniformly one of the group consisting of green, red and blue LED bulbs 28*a* and the second color LED bulbs 28*a* are uniformly one of another of the group consisting of green, red and blue LED bulbs 28*a*. The most common colors used in LED lighting technology when only a few bulbs are used are red, green and blue. Any combination of colors can work as long as the color is brilliant enough to be noticed by simply looking at the console 12. Red, green and blue LED bulbs 28*a* are generally bright enough to be preferred colors to consider in the present invention, although the present invention is not limited to these colors.

On the other hand, when the illuminated colors are generated using software to display the illuminated indicia 16 onto a touch screen 26, the highlighting means 28*b* for illuminating the selected indicia 16 includes means for selectively illuminating with one of a first color mode and a second color mode. Again, as with the LED technology, any color combination (such as red, green and other colors like blue) or feature such as blinking or flashing can be programmed in the programmable portion of the circuitry.

Although not necessary, when LED bulbs 28*a* and the controller circuit 30 are used in conjunction with an overlay 14*a* having an underlying touch screen 26, the present invention 10 can optionally include a controller circuit protective laminate layer 38 in overlying relationship to the controller circuit 30 and in underlying relationship to the touch screen 26. The protective layer 38 can be made from a material such as a sheet of polymeric resinous material, for example, PLEXIGLAS® or LEXAN® laminate sheets. A 1/16 inch to 3/8 inch thick sheet should be sufficient. Although the examples given are typically clear laminates, other polymeric composites may be used or even-a metallic sheet may be used as long as the metallic sheet can not come in contact with the circuit board so as to short out the circuitry.

For a small restaurant having a host station and a relative small floor plan where a wait station is close to the kitchen, a system 10 that has two or three monitoring consoles 12 should be sufficient. Of course, larger restaurant will need more units if greater efficiency is desired.

The consoles 12 are typically interconnected with 3–4 wire communication cables and the consoles 12 have appropriate RJ-In and RJ-Out connection ports for interconnecting the consoles.

An example of typical considerations for locations of consoles 12, the system 10 can have one monitoring console 12 located at the host station 40*a* of the restaurant where the system 10 is used, and other monitoring consoles 12 can be located near one of one or more wait stations 40*b*, one or more bussing stations 40*c*, a kitchen station 40*d*, a manager on duty station 40*e* and a combination of said one or more wait stations 40*b*, one or more bussing stations 40*c*, the kitchen station 40*d*, and the manager on duty station 40*e*. If seating is in a lounge area and a station is located in this area, then a console 12 could be located in the lounge station 40*f*, if deemed beneficial to the staff. Each monitoring console 12 located in any of these stations is in electrical operative communication with each other so that any status change input made at any one monitoring console 12 is simultaneously communicated to the other monitoring consoles 12.

As an example of the operation of one of the combinations of the LED bulbs 28*a* or highlight illumination 28*b*, when the table status for a specific table 18 is vacant, the first and second color illumination means 28 (28*a*,28*b*) which are generally aligned under the indicia 16 for the specific vacant table 18, are not illuminated. When the table status for a specific table 18 is occupied, the first color illumination means 28 (28*a*,28*b*) which is aligned under the indicia 16 for the specific table 18 occupied is illuminated. When a specific table 18 is designated to be on HOLD, the second color illumination means 28(28*a*,28*b*) which is aligned under the indicia 16 for the table 18 to be held is illuminated.

Generally, the present invention has a system configuration that has no less than two (2) monitors and it is anticipated that no more than five (5) monitors on a single network. For larger restaurants, more may be required but for most restaurants, 2 to 5 monitors should suffice. A communications network is incorporated. In most cases, a 3 or 4-wire communication cable and a 2-wire DC supply line is all that is required. Power can be connected to all stations from a single power supply feeding one of the monitors, or separate power may be provided to individual monitors. It is anticipated that one way to power the monitors and its network is a 12VDC power supply rated at about 2 amps DC plus an additional 0.5 amps for each monitor over three monitors on a network. Typical wire cable for the DC supply line is a 2-conductor, 18 AWG stranded copper wire. The DC transformer can be incorporated in the power line, which plugs into a 110 VAC outlet, or the transformer can be built into the circuitry of each monitor when powered separately or built into the first monitor fed by the power supply when power to remaining monitors is supplied from the first monitor. To provide maximum versatility in substituting monitors when needed, it may be better to have a power supply line that incorporates the transformer in the supply line itself. FIG. 4 shows examples of ports. One set of ports is shown as 34*a*, one port for direct connection of a power line and the second for connecting the power in series with networked consoles 12. Another set of ports is shown as 42*a* for the network cabling connections between consoles 12.

The communication cable, typically a 4-conductor flat telephone wire, and the DC power cable, is routed to each monitor location in a daisy-chain type configuration. Connections should be labeled "RJ-12 IN," "RJ-12 OUT, "POWER SUPPLY" (when individual feeds are used), PWR IN," and "PWR OUT." An optional "DIAGNOSE" port (shown in FIG. 4 as 44) is also recommended for manufacture use in diagnosing problems with the system or for re-programming chip if necessary. A typical barrel connector is used to plug the power lines into each unit.

The present invention can also be adapted to include means 46 for displaying alternative restaurant layout, displays. This is ideal when table arrangements are modified in the restaurant. For example, if there is a need to re-arrange tables because of a large group or multiple patrons who want to be seated in the same area or at a group of joined tables, the restaurant staff may decide to group tables 13, 15, 17, and 19 from the arrangement shown in FIG. 2 to the arrangement depicted in FIG. 2*a*. This can be done by the use of another overlay 14*a* of the restaurant tables superimposed on the existing layout overlay 14*a*, that is, overlying in a face-to-face relationship with the restaurant overlay 14*a* originally provided with the monitoring-station. If the layout is image depicted by the use of software, typical groupings can be pre-programmed and when needed pulled up to provide the, appropriate image 14*b* of the table layout.

Figure 5:
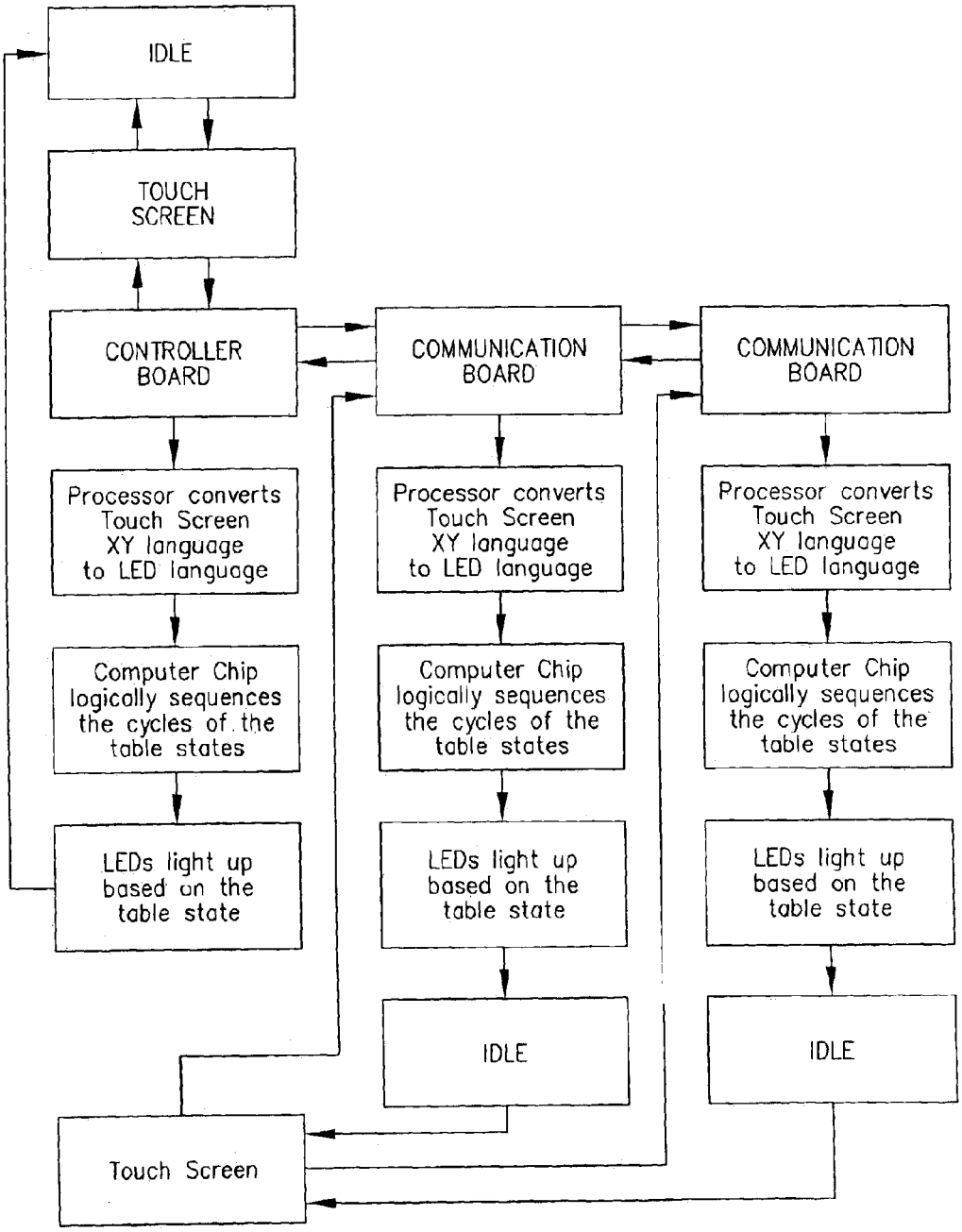
FIG. 5 is an example in the form of a flow chart where LED technology is used in the invention, depicting conceptually how the invention works.

FIG. 5 is an example in the form of a flow chart where LED technology is used in the invention, depicting conceptually how the invention works. This may be oversimplified but it does allow one to better understand the process of how the invention works. This specific flow chart depicts a process where the embodiment of FIGS. 6*a* and 6*b* are employed.

Figure 6A:
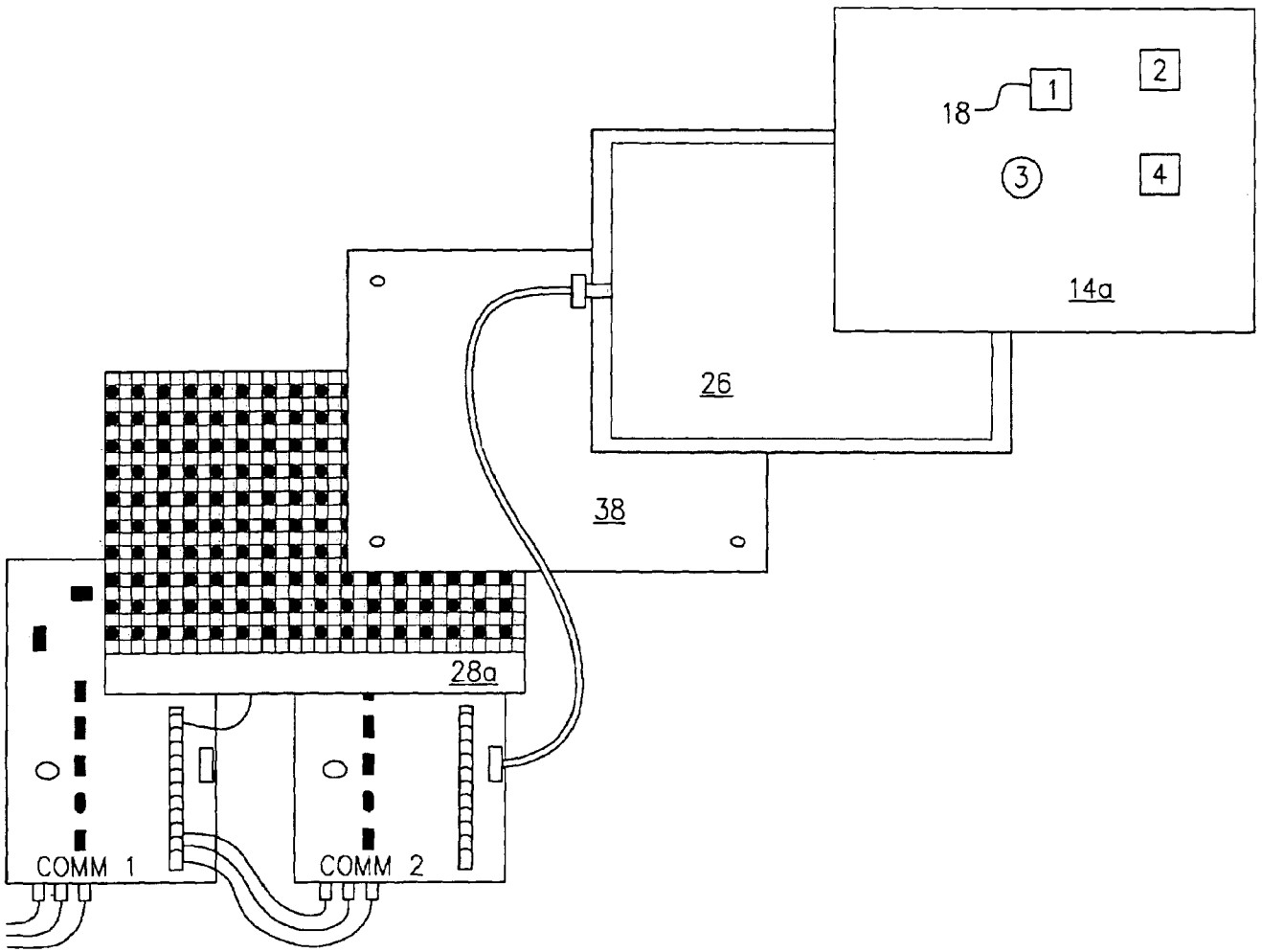
FIG. 6*a* is an exploded view of typical components used in one embodiment of the invention (also depicted in FIG. 6*b*), with the board labeled "COMM 1" representing the controller board and the board labeled "COMM 2" representing the Touch Screen Processor.
Figure 6B:
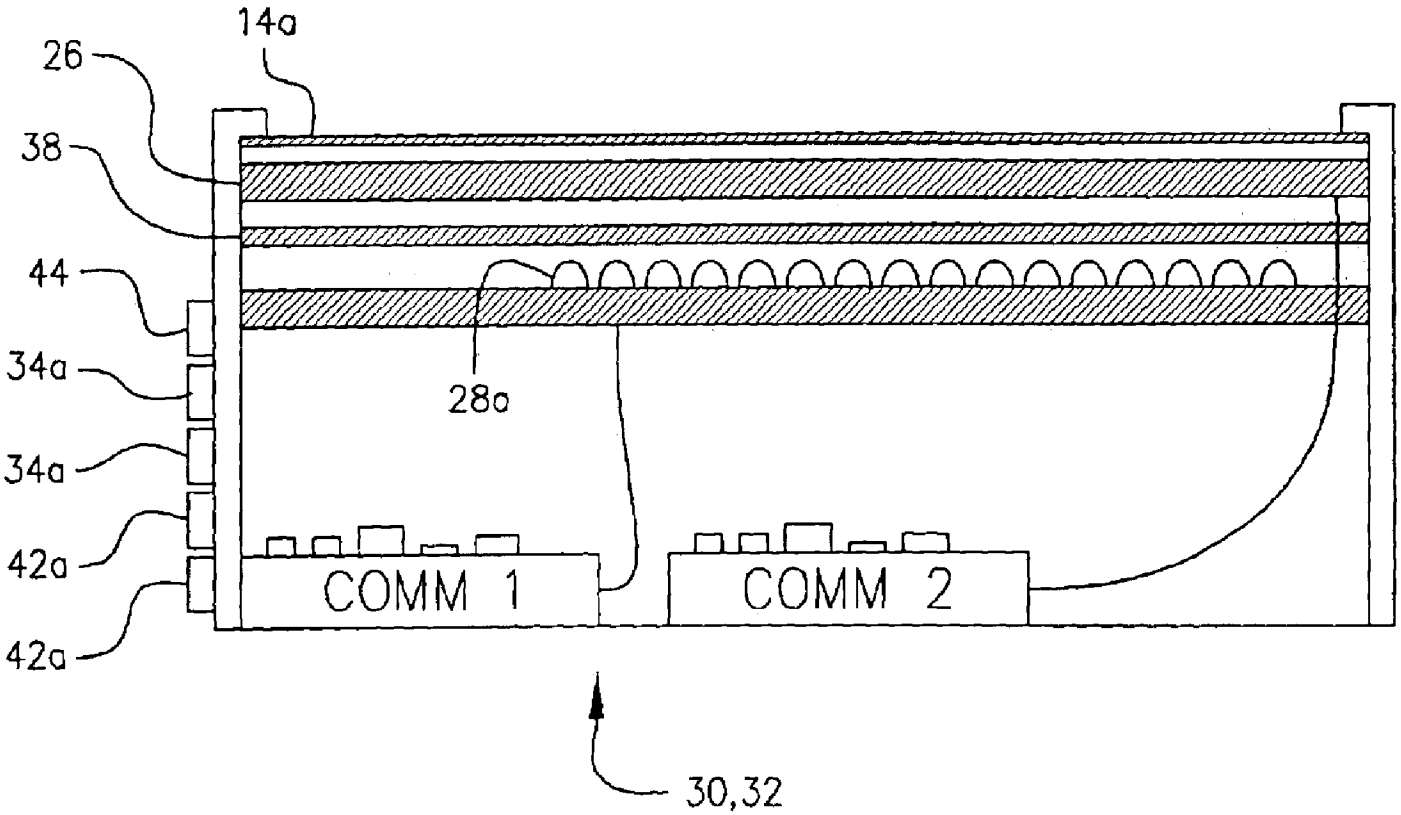
FIG. 6*b* is a cross-sectional schematic view of a typical conceptual component arrangement of the embodiment of FIG. 6*a;*

FIG. 6*a* is an exploded view of typical components used in one embodiment of the invention and FIG. 6*b* is a cross-sectional schematic view of a typical conceptual component arrangement of the embodiment of FIG. 6*a*. Again, the components depicted are representative of the embodiment where an overlay 14*a* is used in conjunction with an underlying touch screen 26 and the circuitry 30,32 underlying the touch screen 26 with LED bulbs 28*a* as the source of lighting the indicia 16.

Figure 7:
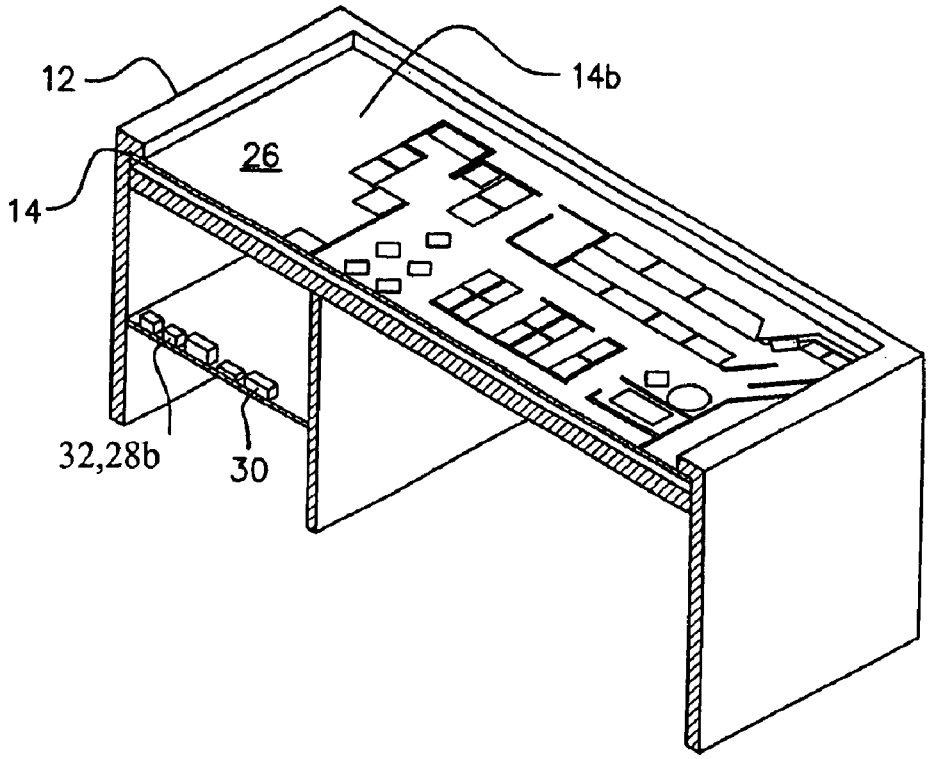
FIG. 7 is a cross-sectional schematic view of another embodiment of the present invention where a computer-like touch screen is used and the images and illumination are totally software driven.

FIG. 7 is a cross-sectional schematic view of another embodiment of the present invention where a computer-like touch screen 26 is used and the images 14*b* and illumination 28*b* are totally software driven.

Figure 8:
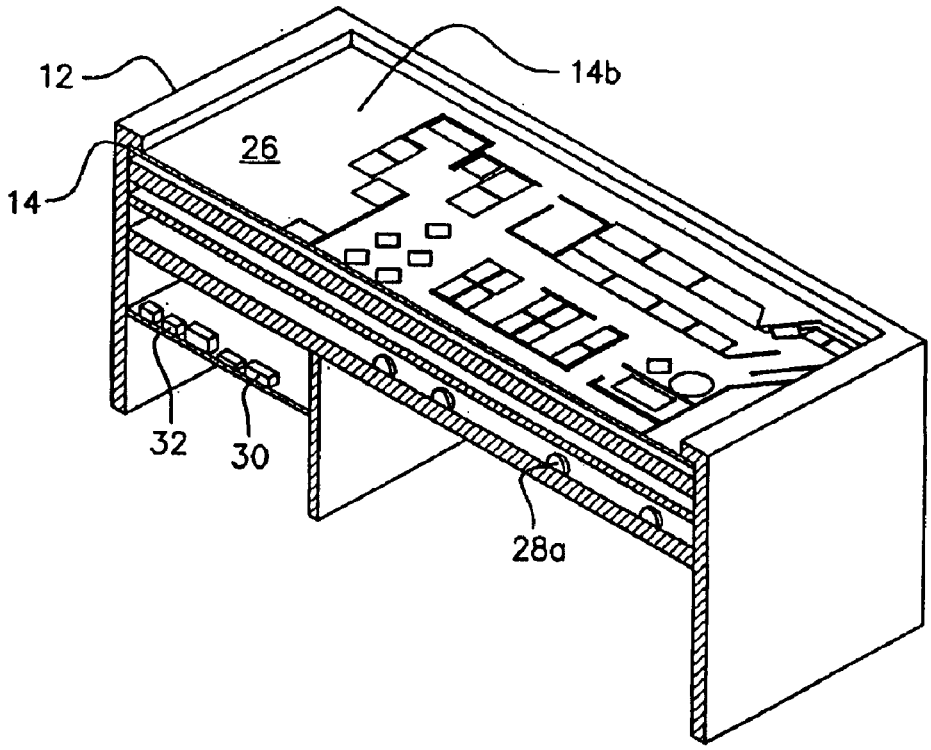
FIG. 8 is a cross-sectional schematic view of still another embodiment where the images are pictured on a computer-like touch screen but the illumination is done using LED technology.

FIG. 8 is a cross-sectional schematic view of still another embodiment where the images 14*b* are pictured on a computer-like touch screen 26 but the illumination is done using LED technology 28*a*.

Figure 9A:
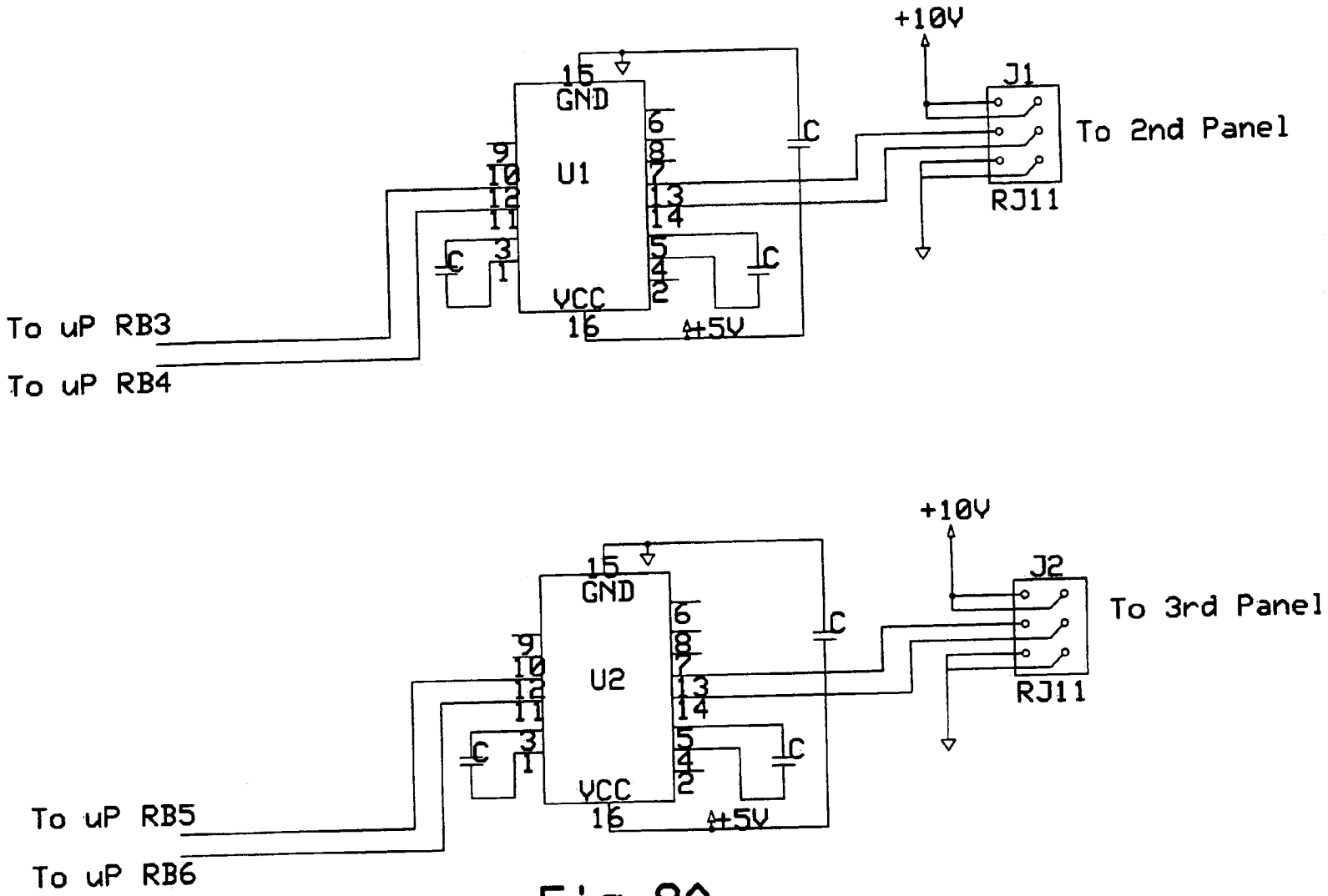
FIGS. 9A–9B represent an electrical schematic of one example of how to assemble the circuitry to operate a system using a basic touch screen, LED technology and a restaurant overlay.
Figure 9B:
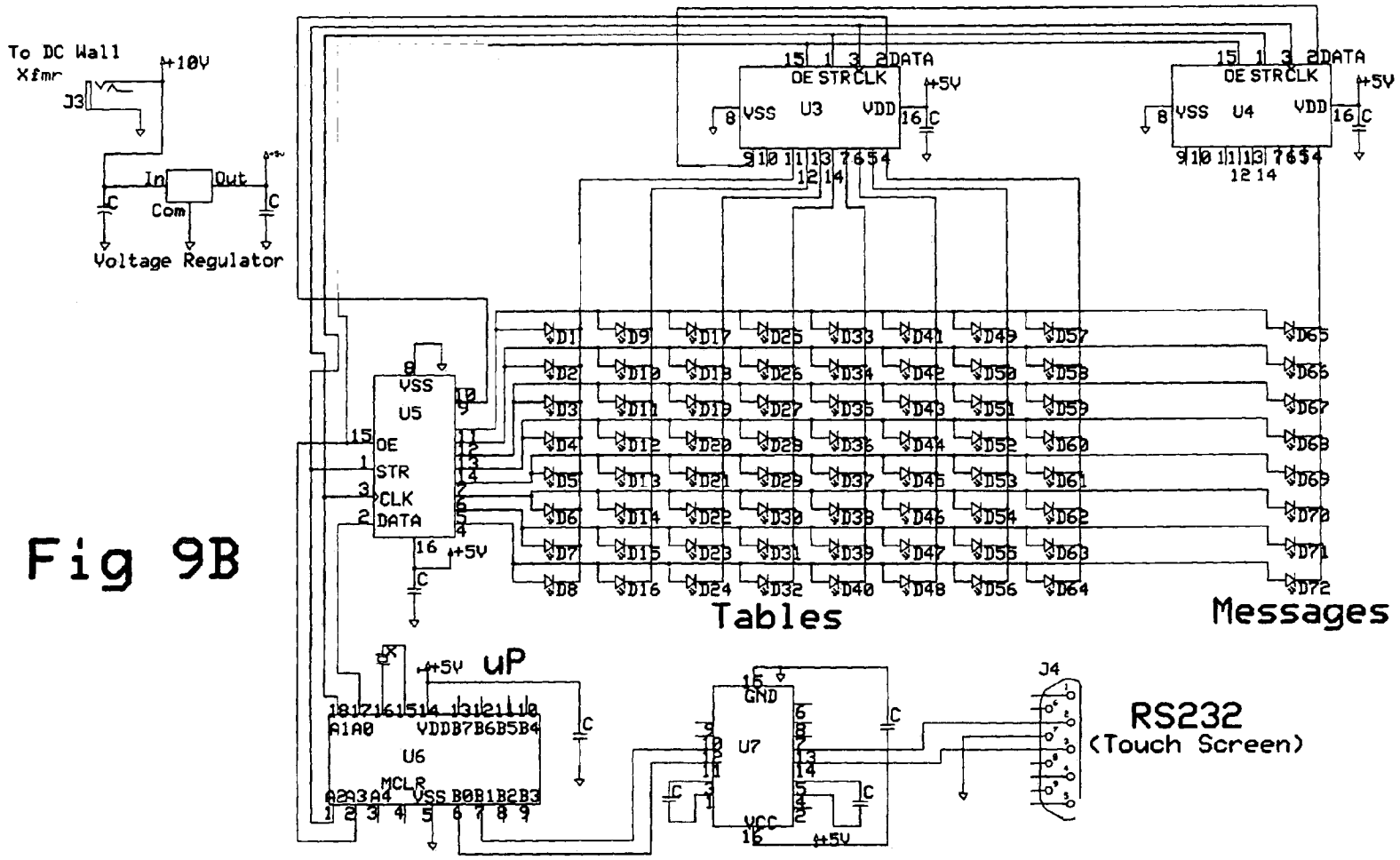

FIGS. 9A–9B represent an electrical schematic of one example of how to assemble the circuitry to operate a system using a basic touch screen 26, LED technology 28*a* and a restaurant overlay 14*a*. As schematically shown in the drawings, the circuit is totally dependant on the microprocessor, U6, for control. Communication to like units is accomplished by U1 and U2 shown in FIG. 9A through the microprocessor, U6 of FIG. 9B.

The following is observed in FIG. 9B.

An external touch screen provides input through U7. The microprocessor interprets the coded signal and assigns a single bit in an X register and another single bit in a Y register. The microprocessor generates a serial stream from the X and Y registers and loads the serial wired parallel converters, U3, U4, U5. The two bits sent out light a single LED. The placement for the LED is determined from the coded signal of the touch screen. Changeable software in the microprocessor controls how the LED is lighted and how different touch screen strokes affect circuit operation.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A networked restaurant table turn control and display system comprising:

two or more monitoring consoles, each monitoring console comprising:

means for displaying a restaurant layout having indicia, the indicia being representative of tables available for seating in the restaurant and being for communicating to the staff working in the restaurant, one of a dinner wait of a pre-set number of patrons or less, a dinner wait of a pre-set number of patrons or more, a need to call the manager on duty to the front desk, a table reservation and hold mode and combinations thereof;

touch screen means for activating desired status changes on the system such that when the restaurant layout is touched on a selected indicia, the desired status change on the networked system for the selected indicia is activated;

means for illuminating the selected indicia;

a controller circuit in electronic operative communication with the touch screen means and the means for illuminating the selected indicia, the controller circuit further including programmable circuitry means for operating and controlling the networked system, including providing status changes and communicating such status changes simultaneously to other monitoring consoles electrically and operatively connected to said monitoring console;

the status changes including table status changes and communications to the staff working in the restaurant of one of the dinner wait of the pre-set number of patrons or less, the dinner wait of the pre-set number of patrons or more, the need to call the manager on duty to the front desk, the table reservation and hold mode and the combination thereof; and means for providing electrical power to each monitoring console.

2. The system according to claim 1, wherein the means for illuminating the selected indicia is a plurality of spaced-apart light emitting diode (LED) bulbs arranged in an underlying relationship to the touch screen means, such that when one of the plurality of LED bulbs is lighted under the selected indicia, the selected indicia is illuminated so as to be readily observable when looking at the monitoring console.

3. The system according to claim 1, wherein the means for displaying the restaurant layout having indicia comprises a display screen on which an image of the desired restaurant layout, which is pre-programmed in the programmable circuitry means, is displayed; and wherein the means for illuminating the selected indicia comprises highlighting means for illuminating selected indicia, said highlighting means being software driven and pre-programmed in the programmable circuitry means.

4. The system according to claim 1, wherein the means for displaying the restaurant layout having indicia comprises a display screen on which an image of the desired restaurant layout, which is pre-programmed in the programmable circuitry means, is displayed, and wherein the means for illuminating the selected indicia comprises a plurality of spaced-apart light emitting diode (LED) bulbs arranged in an underlying relationship to the touch screen means, such that when one of the plurality of LED bulbs is lighted under the selected indicia, the selected indicia is illuminated so as to be readily observable when looking at the display screen.

5. The system according to claim 1, wherein a portion of the indicia representative of tables available for seating in the restaurant is arranged in an array corresponding to the table arrangement for the restaurant in which the networked system is intended to be used.

6. The system according to claim 1, wherein the means for displaying the restaurant layout further comprises:

a designated legend and light status indicia portion indicative of the meaning of the light status observed under each of the indicia representative of tables available; for seating in the restaurant.

7. The system according to claim 6, wherein the designated legend indicia portion includes selected indicia for vacant table, table ready for bussing, table not bussed within desired time period, and table occupied.

8. The system according to claim 7, wherein the light status indicia portion includes "OFF" for each vacant table, blinking for each table ready for bussing, flashing for each table not bussed within desired time period and "ON" for each table occupied.

9. The system according to claim 2, wherein the plurality of spaced-apart LED bulbs, which are aligned beneath the indicia representative of each table are grouped in combinations of a first color LED bulb and a second color LED bulb.

10. The system according to claim 3, wherein the highlighting means for illuminating the selected indicia includes means for selectively illuminating with one of a first color mode and a second color mode.

11. The system according to claim 4, wherein the plurality of spaced-apart LED bulbs, which are aligned beneath the indicia representative of each table are grouped in combinations of a first color LED bulb and a second color LED bulb.

12. The system according to claim 1, wherein the means for providing electrical power to each monitoring console is a DC power source.

13. The system according to claim 1, wherein each monitoring console networked in the system is in electrical operative communication with each other so that any status change input made at one monitoring console is simultaneously communicated to the other monitoring consoles.

14. The system according to claim 1, wherein the system has one monitoring console located at the host station of the restaurant where the system is used, and other monitoring consoles are located near one of one or more wait stations, one or more bussing stations, a kitchen station, a manager on duty station and a combination of said one or more wait stations, one or more bussing stations, kitchen station, and manager on duty station, each monitoring console being in electrical operative communication with each other so that any status change input made at any one monitoring console is simultaneously communicated to the other monitoring consoles.

15. The system according to claim 9, wherein when the table status for a specific table is vacant, the first and second color LED bulbs under the indicia for the specific vacant table, are not illuminated.

16. The system according to claim 10, wherein when the table status for a specific table is vacant, the first and second color modes under the indicia for the specific vacant table, are not illuminated.

17. The system according to claim 11, wherein when the table status for a specific table is vacant, the first and second color LED bulbs under the indicia for the specific vacant table, are not illuminated.

18. The system according to claim 9, wherein when the table status for a specific table is occupied, the first color LED bulb under the indicia for the specific table occupied is illuminated.

19. The system according to claim 10, wherein when the table status for a specific table is occupied, the first color mode under the indicia for the specific table occupied is illuminated.

20. The system according to claim 11, wherein when the table status for a specific table is occupied, the first color LED bulb under the indicia for the specific table occupied is illuminated.

21. The system according to claim 9, wherein when a specific table is designated to be on HOLD, the controller circuit in the at least one of said two or more monitoring consoles is configured and pre-programmed to activate and illuminate the second color LED bulb under the indicia for the table to be held.

22. The system according to claim 10, wherein when a specific table is designated to be on HOLD, the controller circuit in the at least one of said two or more monitoring consoles is configured and pre-programmed to activate and illuminate the second color mode under the indicia for the table to be held.

23. The system according to claim 11, wherein when a specific table is designated to be on HOLD, the second color LED bulb under the indicia for the table to be held is illuminated.

24. The system according to claim 1, further comprising:

means for displaying alternative restaurant layout displays may be selected when table arrangements are modified in the restaurant.

* * * * *